US010144626B2

(12) United States Patent
Kuck et al.

(10) Patent No.: US 10,144,626 B2
(45) Date of Patent: Dec. 4, 2018

(54) FORK CARRIAGE APPARATUS FOR A MATERIALS HANDLING VEHICLE

(71) Applicant: Crown Equipment Corporation, New Bremen, OH (US)

(72) Inventors: Jay L. Kuck, St. Marys, OH (US); Lee M. Wente, Minster, OH (US)

(73) Assignee: Crown Equipment Corporation, New Bremen, OH (US)

( * ) Notice: Subject to any disclaimer, the term of this patent is extended or adjusted under 35 U.S.C. 154(b) by 550 days.

(21) Appl. No.: 14/331,650

(22) Filed: Jul. 15, 2014

(65) Prior Publication Data

US 2014/0326543 A1 Nov. 6, 2014

Related U.S. Application Data

(63) Continuation of application No. 12/557,146, filed on Sep. 10, 2009, now Pat. No. 8,851,825.

(60) Provisional application No. 61/096,749, filed on Sep. 12, 2008, provisional application No. 61/096,745, filed on Sep. 12, 2008.

(51) Int. Cl.

| | |
|---|---|
| ***B66F 9/06*** | (2006.01) |
| ***B66F 9/14*** | (2006.01) |
| ***B66F 9/08*** | (2006.01) |
| ***B66F 9/10*** | (2006.01) |
| ***B66F 9/12*** | (2006.01) |

(52) U.S. Cl.

CPC ..... *B66F 9/148* (2013.01); *B66F 9/06* (2013.01); *B66F 9/08* (2013.01); *B66F 9/087* (2013.01); *B66F 9/10* (2013.01); *B66F 9/122* (2013.01); *B66F 9/082* (2013.01)

(58) Field of Classification Search

None

See application file for complete search history.

(56) References Cited

U.S. PATENT DOCUMENTS

| | | | |
|---|---|---|---|
| 2,635,711 | A | 4/1953 | Turner |
| 2,747,689 | A | 5/1956 | Abbe |
| 2,915,144 | A | 12/1959 | Olson |

(Continued)

FOREIGN PATENT DOCUMENTS

| | | | |
|---|---|---|---|
| DE | 1131146 | B | 6/1962 |
| DE | 1257676 | B | 12/1967 |

(Continued)

OTHER PUBLICATIONS

Avila, Jose Enrique Carzares; Office Action; Mexican Patent Application No. MX/a/2011/002736; dated Apr. 20, 2015; Instituto Mexicano de la Propiedad Industrial; Mexico.

(Continued)

*Primary Examiner* — Saul Rodriguez

*Assistant Examiner* — Willie Berry, Jr.

(74) *Attorney, Agent, or Firm* — Stevens & Showalter, LLP

(57) ABSTRACT

A materials handling vehicle is provided including a vehicle power unit, a monomast coupled to the vehicle power unit, and a fork carriage apparatus supported on the monomast. The fork carriage apparatus includes a mast carriage assembly directly coupled to the monomast for vertical movement, a fork carriage mechanism to which forks are mounted, and a reach mechanism coupled to the mast carriage assembly and to the fork carriage mechanism for actuating the fork carriage mechanism to move between an extended position and a retracted position.

9 Claims, 15 Drawing Sheets

(56) References Cited

U.S. PATENT DOCUMENTS

| | | | |
|---|---|---|---|
| 2,915,210 | A | 12/1959 | Ehmann |
| 2,925,888 | A | 2/1960 | Kagel |
| 2,973,878 | A | 3/1961 | Gibson |
| 3,035,663 | A | 5/1962 | Mehlmann |
| 3,061,045 | A | 10/1962 | Gunning |
| 3,082,894 | A | 3/1963 | Gibson |
| 3,095,945 | A | 7/1963 | Mitchell |
| 3,202,242 | A | 8/1965 | Dolphin |
| 3,344,890 | A | 10/1967 | Loef |
| 3,372,823 | A | 3/1968 | Gibson et al. |
| 3,472,341 | A | 10/1969 | Stammen |
| 3,490,633 | A | 1/1970 | Avis et al. |
| 3,534,664 | A | 10/1970 | Ulinski |
| 3,638,761 | A | 2/1972 | Ohta |
| 3,968,859 | A | 7/1976 | Ehrhardt |
| 3,970,171 | A | 7/1976 | Honecker et al. |
| 3,972,388 | A | 8/1976 | McVeen |
| 3,987,870 | A | 10/1976 | Wojtyna |
| 3,998,345 | A | 12/1976 | Fiehler et al. |
| 3,998,346 | A | 12/1976 | Gibson et al. |
| 4,019,786 | A | 4/1977 | Yarris |
| 4,051,970 | A | 10/1977 | Ramsey |
| 4,084,715 | A | 4/1978 | Stedman |
| 4,354,579 | A | 10/1982 | Low |
| 4,355,703 | A | 10/1982 | Bartow |
| 4,543,031 | A | 9/1985 | Luebrecht et al. |
| 4,552,250 | A | 11/1985 | Luebrecht |
| 4,635,757 | A | 1/1987 | Yamagishi et al. |
| 4,709,786 | A | 12/1987 | David et al. |
| 4,765,441 | A | 8/1988 | David et al. |
| 4,848,520 | A | 7/1989 | Gibel et al. |
| 4,944,368 | A | 7/1990 | Duderstadt |
| 5,022,496 | A | 6/1991 | Klopfleisch et al. |
| 5,046,585 | A | 9/1991 | Ohta et al. |
| 5,657,834 | A | 8/1997 | Plaugher et al. |
| 5,738,187 | A | 4/1998 | Dammeyer et al. |
| 5,992,571 | A | 11/1999 | Lee |
| 6,125,971 | A | 10/2000 | Niebuhr et al. |
| 6,135,694 | A | 10/2000 | Trego et al. |
| 6,533,076 | B1 | 3/2003 | Haverfield et al. |
| 6,851,915 | B2 | 2/2005 | Warner et al. |
| 7,096,999 | B2 | 8/2006 | Lewis et al. |
| 7,182,369 | B2 | 2/2007 | Baumann et al. |
| 8,714,311 | B2 | 5/2014 | Billger et al. |
| 2006/0060409 | A1 | 3/2006 | Dammeyer et al. |
| 2006/0070816 | A1 | 4/2006 | Schroder |
| 2007/0080024 | A1 | 4/2007 | Langenkamp et al. |

FOREIGN PATENT DOCUMENTS

| | | | |
|---|---|---|---|
| EP | 0678474 | A2 | 10/1995 |
| EP | 1046609 | B1 | 10/2004 |
| GB | 944225 | | 12/1963 |
| JP | 4833577 | | 10/1973 |
| JP | 48033577 | B | 10/1973 |
| JP | S5410783 | | 5/1979 |
| JP | H79909 | | 3/1995 |
| NL | 1007308 | C2 | 4/1999 |

OTHER PUBLICATIONS

Menyhart, Steven A., Office Action, Canadian Application No. 2,736,384, dated Jul. 7, 2015, Canadian Intellectual Property Office.

Preliminary Rejection, Korean Application No. 10-2011-7008244, dated Jul. 14, 2015, Korean Intellectual Property Office.

Crown; TSP Series; Turret Stockpicker; SF-12183 Rev. Jan. 2006; 1994-2006; Crown Equipment Corporation; New Bremen, Ohio.

Crown; TSP 6000 Series; Turret Order Picker; TSP SPEC GB; Jun. 2006; Crown Gablestapler GmbH & Co., KG; Roding, Germany.

Crown; WAV 50 Series; Work Assist Vehicle; WAVE SPEC GB; Mar. 2005; Crown Gablestapler GmbH & CA, KG; Roding, Germany.

U.S. Appl. No. 12/557,116, filed Sep. 10, 2009; entitled "Monomast for a Materials Handling Vehicle".

Crown; RR 5200 Series; Reach Truck; VFS-RR5200-01-GB; Jul. 2003; Roding, Germany.

Sheppard, Bruce; International Search Report and Written Opinion of the International Searching Authority; International Application No. PCT/US2009/056534; dated Dec. 17, 2009; European Patent Office.

Sheppard, Bruce; International Search Report and Written Opinion of the International Searching Authority; International Application No. PCT/US2009/056543; dated Dec. 8, 2009; European Patent Office.

Ma, Hongiun; Second Office Action in Chinese Application No. 200980135436.9; dated May 24, 2013; State Intellectual Property Office of the People's Republic of China.

Newman, Paul; Patent Examination Report No. 2 in Australian Application No. 2009291737; dated Jul. 30, 2014; Australian Government, IP Australia; Woden, Australia.

Steven A. Menyhart; Office Action; Canadian Patent Application No. 2736383; dated May 7, 2015; Canadian Intellectual Property Office; Canada.

Notice of Acceptance; Australian Patent Application No. 2009291737; dated Jan. 22, 2015; Australian Intellectual Property Office; Australia.

Paul Newman; Patent Examination Report No. 2; Australian Patent Application No. 2009291737; dated Jul. 30, 2014; Australian Intellectual Property Office; Australia.

Paul Newman; Patent Examination Report No. 1; Australian Patent Application No. 2009291737; dated Jan. 9, 2014; Australian Intellectual Property Office; Australia.

First Office Action; Chinese Patent Application No. 200980141063.6; dated Oct. 30, 2012; State Intellectual Property Office of the People's Republic of China; China.

Kenneth Ross; Rule 71(3) EPC Communication; European Patent Application No. 09792427.8; dated Feb. 25, 2015; European Patent Office; EPO.

Bruce Sheppard; Communication Pursuant to Article 94(3) EPC; European Patent Application No. 09792427.8; dated Nov. 7, 2013; European Patent Office; EPO.

Avila, Jose Enrique Cazares; Office Action; Mexican Patent Application No. MX/a/2011/002736; dated Mar. 8, 2016; Mexican Institute of Industrial Property; Mexico City, Mexico.

Menyhart, Steven A.; Examination Report; Canadian Patent Application No. 2,736,383; dated Mar. 10, 2016; Canadian Intellectual Property Office; Gatineau, QC, Canada.

FORK CARRIAGE APPARATUS FOR A MATERIALS HANDLING VEHICLE

CROSS REFERENCE TO RELATED APPLICATIONS

This application is a continuation of U.S. patent application Ser. No. 12/557,146, entitled "FORK CARRIAGE APPARATUS FOR A MATERIALS HANDLING VEHICLE", filed Sep. 10, 2009, now allowed, which claims the benefit of U.S. Provisional Patent Application No. 61/096,749, filed Sep. 12, 2008, entitled "FORK CARRIAGE APPARATUS FOR A MATERIALS HANDLING VEHICLE", and U.S. Provisional Patent Application No. 61/096,745, filed Sep. 12, 2008, entitled "MONOMAST FOR A MATERIALS HANDLING VEHICLE," the disclosures of which are incorporated by reference herein. Further, this application is related to U.S. patent application Ser. No. 12/557,116, entitled MONOMAST FOR A MATERIALS HANDLING VEHICLE, filed Sep. 10, 2009, now U.S. Pat. No. 8,714,311, the entire disclosure of which is incorporated by reference herein.

FIELD OF THE INVENTION

The present invention relates to a materials handling vehicle comprising a fork carriage apparatus and, more particularly, to such a vehicle including a power unit and a monomast coupled to the power unit and supporting a fork carriage apparatus including a fork carriage assembly wherein a reach mechanism is provided for effecting movement of the fork carriage assembly between an extended position and a compact retracted position.

BACKGROUND OF THE INVENTION

U.S. Pat. No. 4,552,250 to Luebrecht discloses a lift truck including a monomast comprising an outer, movable mast mounted to telescope over an inner mast which is fixed to a frame. Each mast is configured to have a substantially continuous, unitary tubular body to provide strength for resisting torsional and bending loads applied to the mast.

U.S. Pat. No. 5,022,496 to Klopfleisch et al. discloses a materials handling vehicle including a telescoping monomast structure supporting a vertically movable platform assembly. The platform assembly supports a pair of extendable forks carried by a fork carriage assembly. An auxiliary lift cylinder is provided to move the forks vertically relative to the platform assembly.

U.S. Pat. No. 5,738,187 to Dammeyer et al. discloses a fork lift truck including a mast assembly formed by a pair of stationary channel members and nested movable channel members. A pair of forks is supported on a fork carriage that is mounted to the mast assembly by a scissors reach mechanism. The scissors reach mechanism is supported to a vertically movable carriage assembly located between the channel members of the mast assembly.

U.S. Pat. No. 6,851,915 to Warner et al. discloses a load handling device for an industrial truck. The load handling device is described as comprising a lift carriage that is guided on the outer sides of a lift frame by rollers. Load forks are supported on a reach carriage, and the reach carriage includes guide rails engaged with rollers on the outer sides of the lift carriage. A pair of hydraulic cylinders actuate the reach carriage to displace the load forks in a longitudinal direction of the industrial truck.

An improved fork carriage apparatus for a materials handling vehicle is desired to provide a reach mechanism on a materials handling vehicle having a monomast structure without adversely increasing the overall longitudinal length of the vehicle.

SUMMARY OF THE INVENTION

In accordance with a first aspect of the invention, a materials handling vehicle is provided comprising a vehicle power unit; a monomast coupled to the vehicle power unit; and a fork carriage apparatus supported on the monomast. The fork carriage apparatus may comprise a mast carriage assembly directly coupled to the monomast for vertical movement relative to the monomast; a fork carriage mechanism to which forks are mounted; and a reach mechanism including a scissors structure coupled to the mast carriage assembly and the fork carriage mechanism for effecting movement of the fork carriage mechanism between an extended position and a retracted position.

The scissors structure of the reach mechanism may comprise first and second inner arms, each of the first and second inner arms including a first end directly coupled to the mast carriage assembly and a second end coupled to the fork carriage mechanism; first and second outer arms, each of the first and second outer arms including a first end directly coupled to the mast carriage assembly and a second end coupled to the fork carriage mechanism; and wherein the first and second inner arms are coupled to the first and second outer arms.

The reach mechanism may further comprise a cross member structure extending between the first and second inner arms, the cross member structure including at least one cross member having lateral edges attached adjacent to front edges of the first and second inner arms to define an inner arm weldment.

The mast carriage assembly may comprise at least one carriage frame member extending laterally across a front side of the monomast and located in vertically spaced relation to the cross member when the fork carriage mechanism is in the retracted position.

The carriage frame member and the cross member may intersect a common vertical plane extending in front of and generally parallel to the monomast when the fork carriage mechanism is in the retracted position.

The cross member structure may comprise a plurality of cross members generally aligned in a common plane extending adjacent to the front edges of the first and second inner arms.

Two of the cross members may be located on opposing sides of the carriage frame member when the fork carriage mechanism is in the retracted position.

The fork carriage mechanism may include at least one laterally extending fork frame member and, when the fork carriage mechanism is in the retracted position, the fork frame member and the cross member intersect a common vertical plane extending in front of and generally parallel to the monomast.

The mast carriage assembly may further include first and second side members located for movement along outer sides of the monomast, and the first ends of the inner and outer arms may be coupled to the first and second side members.

The first ends of the first and second inner arms may be supported for vertical movement along vertical tracks in the first and second side members, and the first ends of the first and second outer arms may be coupled to the first and second side members at respective pivot locations.

The inner and outer arms may extend substantially vertically and be located in overlapping relationship over the first and second side members when the fork carriage mechanism is in the retracted position.

The fork carriage apparatus may further comprise a piston/cylinder apparatus coupled between at least one of the side members and a respective one of the outer or inner arms for actuating the reach mechanism between the extended and retracted positions.

In accordance with a second aspect of the invention, a materials handling vehicle is provided comprising a vehicle power unit; a monomast coupled to the vehicle power unit; and a fork carriage apparatus supported on the monomast. The fork carriage apparatus may comprise a mast carriage assembly movably coupled to the monomast and including at least one carriage frame member extending laterally across a front side of the monomast; a fork carriage mechanism to which forks are mounted; and a reach mechanism coupled to the mast carriage assembly and the fork carriage mechanism for effecting movement of the fork carriage mechanism between an extended position and a retracted position, the reach mechanism including at least one laterally extending cross member which is located in vertically spaced relation to the carriage frame member when the fork carriage mechanism is in the refracted position.

The at least one carriage frame member may comprise first and second carriage frame members extending laterally across the front side of the monomast, and the cross member may be located between the first and second carriage frame members when the fork carriage mechanism is in the retracted position.

The carriage frame member and the cross member may intersect a common vertical plane extending in front of and generally parallel to the monomast when the fork carriage mechanism is in the retracted position.

The reach mechanism may comprise a plurality of cross members and the carriage frame member may be located between two of the cross members when the fork carriage mechanism is in the retracted position.

The fork carriage mechanism may include at least one laterally extending fork frame member, and the fork frame member may be located between the two cross members when the fork carriage mechanism is in the retracted position.

In accordance with a third aspect of the invention a materials handling vehicle is provided comprising a vehicle power unit; a monomast comprising a first stage weldment coupled to the vehicle power unit, a second stage weldment positioned to telescope over the first stage weldment, and a third stage weldment positioned to telescope over the first and second stage weldments; and a fork carriage apparatus supported on the monomast. The fork carriage apparatus may comprise a mast carriage assembly directly coupled to the third stage weldment for vertical movement relative to the monomast and including side members; a fork carriage mechanism to which forks are mounted; and a reach mechanism including a scissors structure coupled to the mast carriage assembly and to the fork carriage mechanism for effecting movement of the fork carriage mechanism between an extended position and a retracted position.

The scissors structure of the reach mechanism may comprise first and second inner arms, each of the first and second inner arms including a first end directly supported for movement along a vertical track in a respective one of the side members and a second end coupled to the fork carriage mechanism; first and second outer arms, each of the first and second outer arms including a first end directly coupled at a pivot point to a respective one of the side members and a second end coupled to the fork carriage mechanism; and the first and second inner arms coupled to the first and second outer arms.

A plurality of cross members may extend between the first and second inner arms, the cross members having lateral edges attached adjacent to front edges of the first and second inner arms to define an inner arm weldment.

The inner and outer arms may extend substantially vertically and may be located in overlapping relationship over the side members when the fork carriage mechanism is in the retracted position.

DETAILED DESCRIPTION OF THE INVENTION

Figure 1:
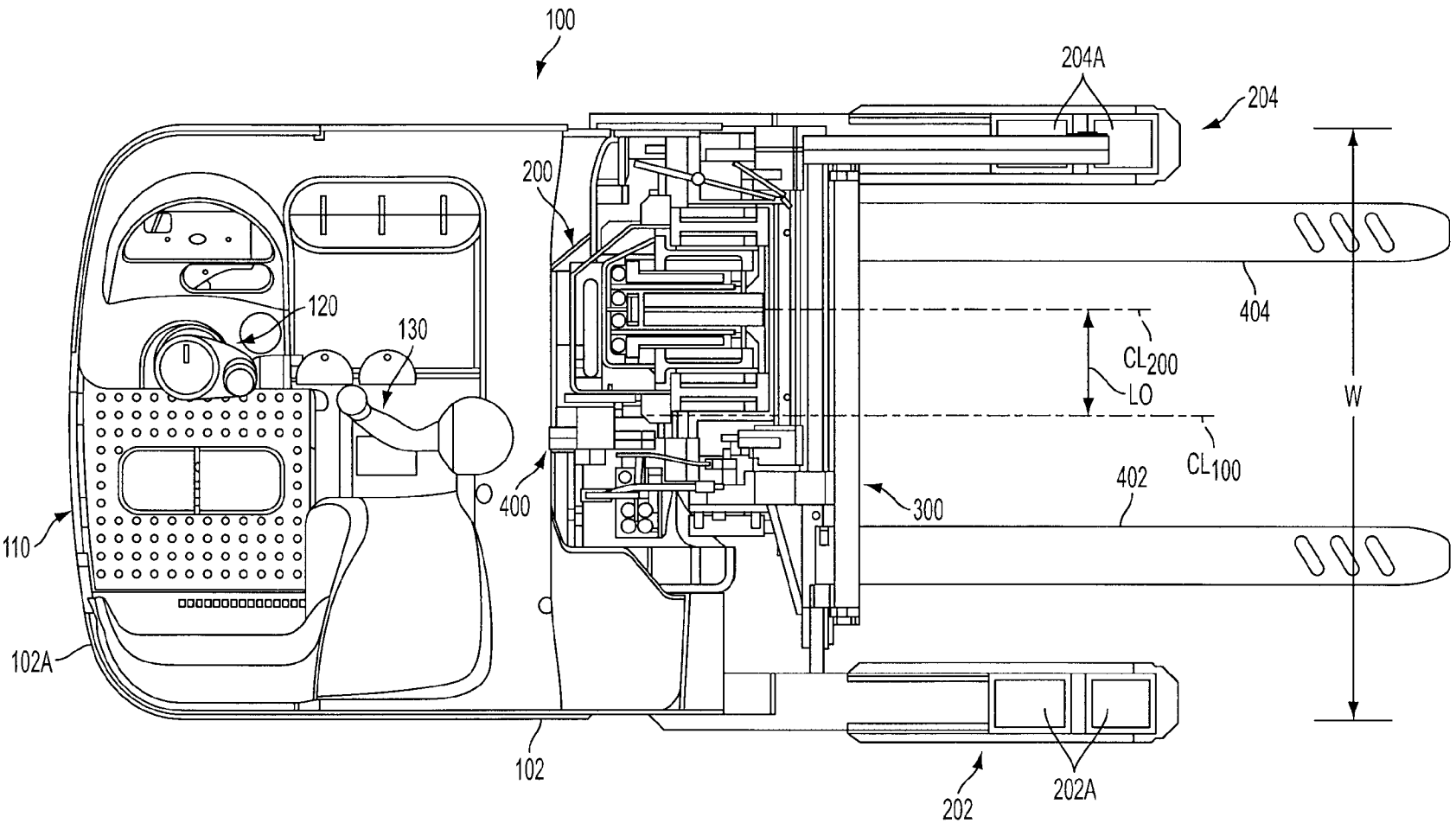
FIG. 1 is a plan view of a materials handling truck including a fork carriage apparatus in accordance with the present invention.

FIG. 1 illustrates a top view of a rider reach truck 100. A monomast 200, a fork carriage apparatus 300 and a fork carriage apparatus lift structure 400, constructed in accordance with the present invention, are incorporated into the rider reach truck 100, see also FIG. 3. While the present invention is described herein with reference to the rider reach truck 100, it will be apparent to those skilled in the art that the invention and variations of the invention can be more generally applied to a variety of other materials handling vehicles, such as a sit-down counterbalanced truck or a stand-up counterbalanced truck.

Figure 2:
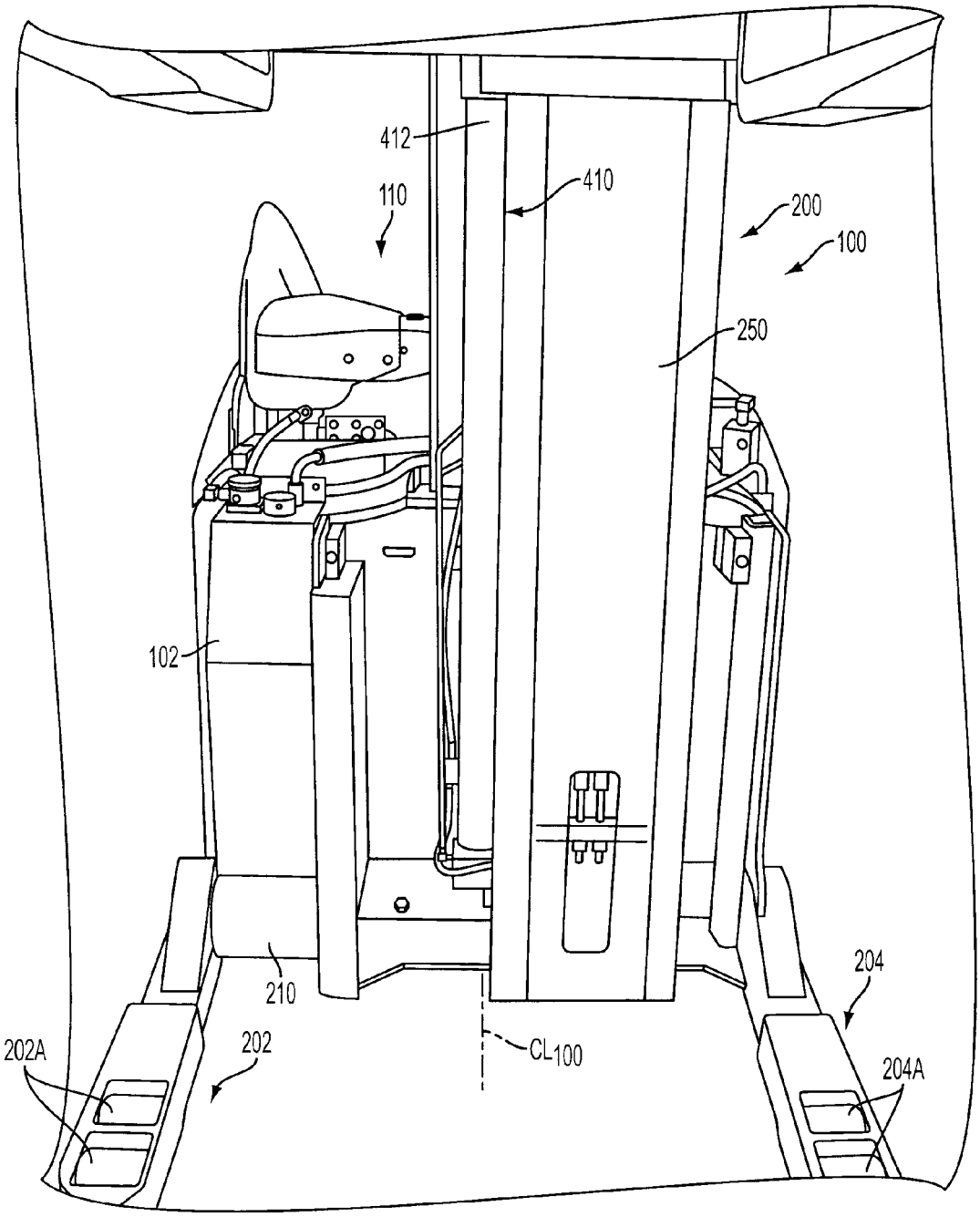
FIG. 2 is a front elevational view of the materials handling truck illustrated in FIG. 1 with the fork carriage apparatus raised out of view.

The truck 100 further includes a vehicle power unit 102, see FIGS. 1 and 2, including a longitudinal centerline $CL_{100}$, see FIG. 1. The power unit 102 houses a battery (not shown) for supplying power to a traction motor coupled to a steerable wheel (not shown) mounted near a first corner at the rear 102A of the power unit 102. Mounted to a second corner at the rear 102A of the power unit 102 is a caster wheel (not shown). A pair of outriggers 202 and 204 are mounted to a monomast frame 210, see FIG. 2. The outriggers 202 and 204 are provided with supports wheels 202A and 204A. The battery also supplies power to a motor (not shown), which drives a hydraulic pump (not shown). The pump supplies pressurized hydraulic fluid to the fork carriage lift apparatus structure 400 and to a mast weldment lift structure (not shown).

The vehicle power unit 102 includes an operator's compartment 110, which, in the illustrated embodiment, is positioned on a side of the longitudinal centerline $CL_{100}$ of the vehicle power unit 102 opposite a side where the monomast 200 is positioned, see FIG. 1. An operator standing in the compartment 110 may control the direction of travel of the truck 100 via a tiller 120. The operator may also control the travel speed of the truck 100, and height, extension, tilt and side shift of first and second forks 402 and 404 via a multifunction controller 130, see FIG. 1. The first and second forks 402 and 404 form part of the fork carriage apparatus 300.

The monomast 200 has a longitudinal centerline $CL_{200}$, see FIG. 1. As is apparent from FIG. 1, the monomast longitudinal centerline $CL_{200}$ is offset from, i.e., spaced laterally from, the longitudinal centerline $CL_{100}$ of the vehicle power unit 102. Further, the monomast longitudinal centerline $CL_{200}$ is substantially parallel with the longitudinal centerline $CL_{100}$ of the vehicle power unit 102. Because the monomast longitudinal centerline $CL_{200}$ is not angled or oblique to the longitudinal centerline $CL_{100}$ of the vehicle power unit 102, the overall length of the truck 100 in a direction parallel to the monomast longitudinal centerline $CL_{200}$ can be minimized, i.e., made shorter than a truck including a monomast having a longitudinal centerline that is not parallel to a longitudinal centerline of the vehicle power unit. In the illustrated embodiment, the monomast longitudinal centerline $CL_{200}$ is laterally offset approximately 8 inches from the longitudinal centerline $CL_{100}$ of the vehicle power unit 102, see arrow LO in FIG. 1, wherein the vehicle power unit 102 has a width W of about 42 inches. These dimensions can be varied, as will be apparent to one skilled in the art.

Figure 3:
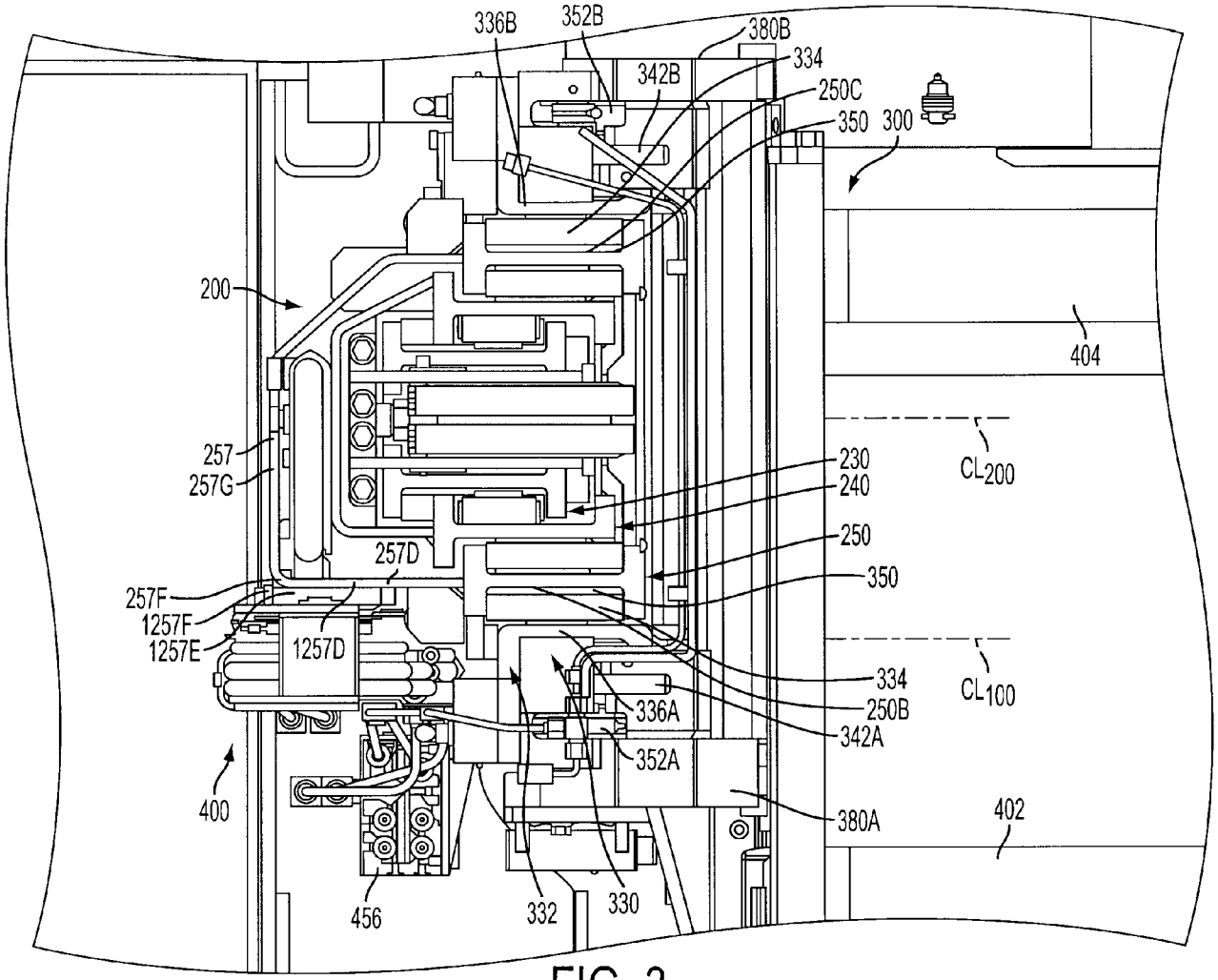
FIG. 3 is a top plan view of a monomast of the materials handling vehicle and including the fork carriage apparatus.

The monomast 200 comprises a first stage weldment 230, a second stage weldment 240 positioned to telescope over the first stage weldment 230 and a third stage weldment 250 positioned to telescope over the first and second stage weldments 230 and 240, see FIG. 3. The monomast 200 may be constructed in essentially the same manner as the monomast disclosed in the previously referenced U.S. patent application Ser. No. 12/557,116, entitled MONOMAST FOR A MATERIALS HANDLING VEHICLE, filed Sep. 10, 2009, now U.S. Pat. No. 8,714,311, which has previously been incorporated by reference herein. The monomast 200 further comprises a mast weldment lift structure (not shown), which effects staged lifting movement of the second and third stage weldments 230 and 240 relative to the first stage weldment 230. The mast weldment lift structure may be constructed in the same manner as the mast weldment lift structure set out in the previously referenced U.S. patent application Ser. No. 12/557,116, entitled MONOMAST FOR A MATERIALS HANDLING VEHICLE, filed Sep. 10, 2009, now U.S. Pat. No. 8,714,311, which has previously been incorporated by reference herein. As is apparent from FIGS. 2 and 3, the monomast 200 comprises a single structure having a unitary tubular form and does not comprise spaced-apart vertical channels or rails joined by horizontal members wherein an open area is located between the spaced-apart vertical channels or rails.

Figure 4:
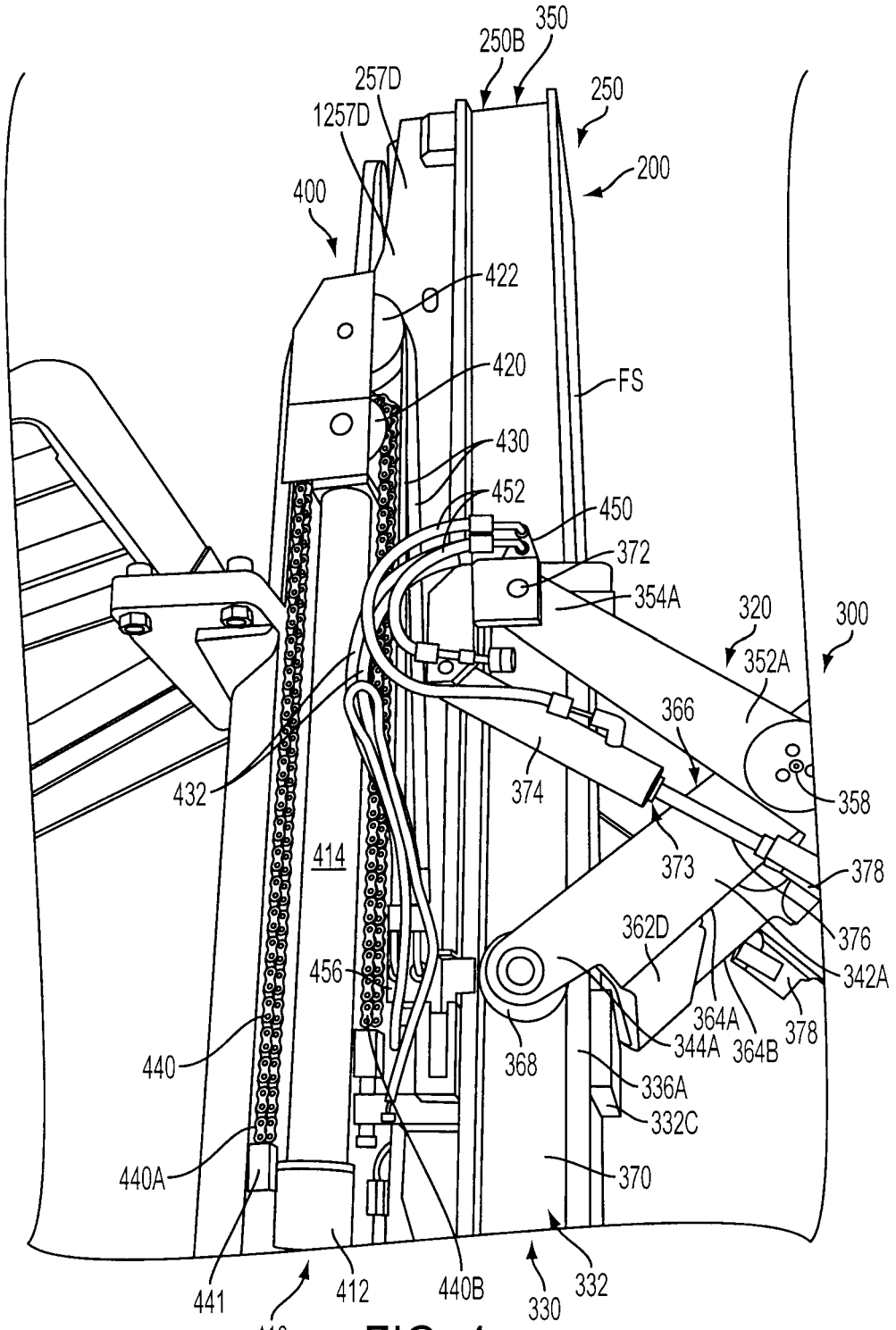
FIG. 4 is a right side view of an upper portion of the monomast and showing a portion of the hydraulic system for providing hydraulic fluid to the fork carriage apparatus.

The fork carriage apparatus 300 is coupled to the third stage weldment 250 so as to move vertically relative to the third stage weldment 250, see FIG. 4. The fork carriage apparatus 300 also moves vertically with the third stage weldment 250 relative to the first and second stage weldments 230 and 240. The fork carriage apparatus 300 comprises a fork carriage mechanism 310 to which the first and second forks 402 and 404 are mounted, see FIG. 5. The fork carriage mechanism 310 is mounted to a reach mechanism 320 which, in turn, is mounted to a mast carriage assembly 330, see FIGS. 4 and 5. The mast carriage assembly 330 comprises a main unit 332 including first and second side members 336A and 336B, see FIGS. 3, 4 and 5. Each of the side members 336A, 336B support a plurality of rollers 334 which are received in tracks 350 formed in opposing outer sides surfaces 250B and 250C of the third stage weldment 250, see FIG. 3. In the illustrated embodiment, the main unit 332 further comprises first, second, third and fourth vertically spaced apart and horizontally extending carriage frame members 332A, 332B, 332C and 332D extending across a front side FS of the monomast 200, see FIGS. 4, 5 and 6. The carriage frame members 332A, 332B, 332C, 332D are rigidly attached to the side members 336A and 336B.

Referring to FIGS. 4, 5, 6 and 7, the reach mechanism 320 comprises a pantograph or scissors structure having first and second inner arms 342A and 342B, and first and second outer arms 352A and 352B. The first and second inner arms 342A and 342B include first ends 344A and 344B directly coupled to the side members 336A and 336B of the mast carriage assembly 330, and second ends 346A and 346B pivotally coupled to the fork carriage mechanism 310. Each of the first ends 344A and 344B includes a roller 368. The rollers 368 are received in vertically extending tracks 370 formed in the outer sides of the side members 336A and 336B. The rollers 368 engaged within the tracks 370 form a sliding coupling between the first ends 344A and 344B of the inner arms 342A and 342B and the side members 336A and 336B.

The first and second outer arms 352A and 352B include first ends 354A and 354B directly coupled to the side members 336A and 336B of the mast carriage assembly 330, and second ends 356A and 356B pivotally coupled to the fork carriage mechanism 310, see FIGS. 4, 5, 6 and 7. Each of the side members 336A and 336B includes a pivot location 372 where the first ends 354A and 354B of the first and second outer arms 352A and 352B are coupled to the side members 336A and 336B, see FIGS. 4 and 5.

Figure 5:
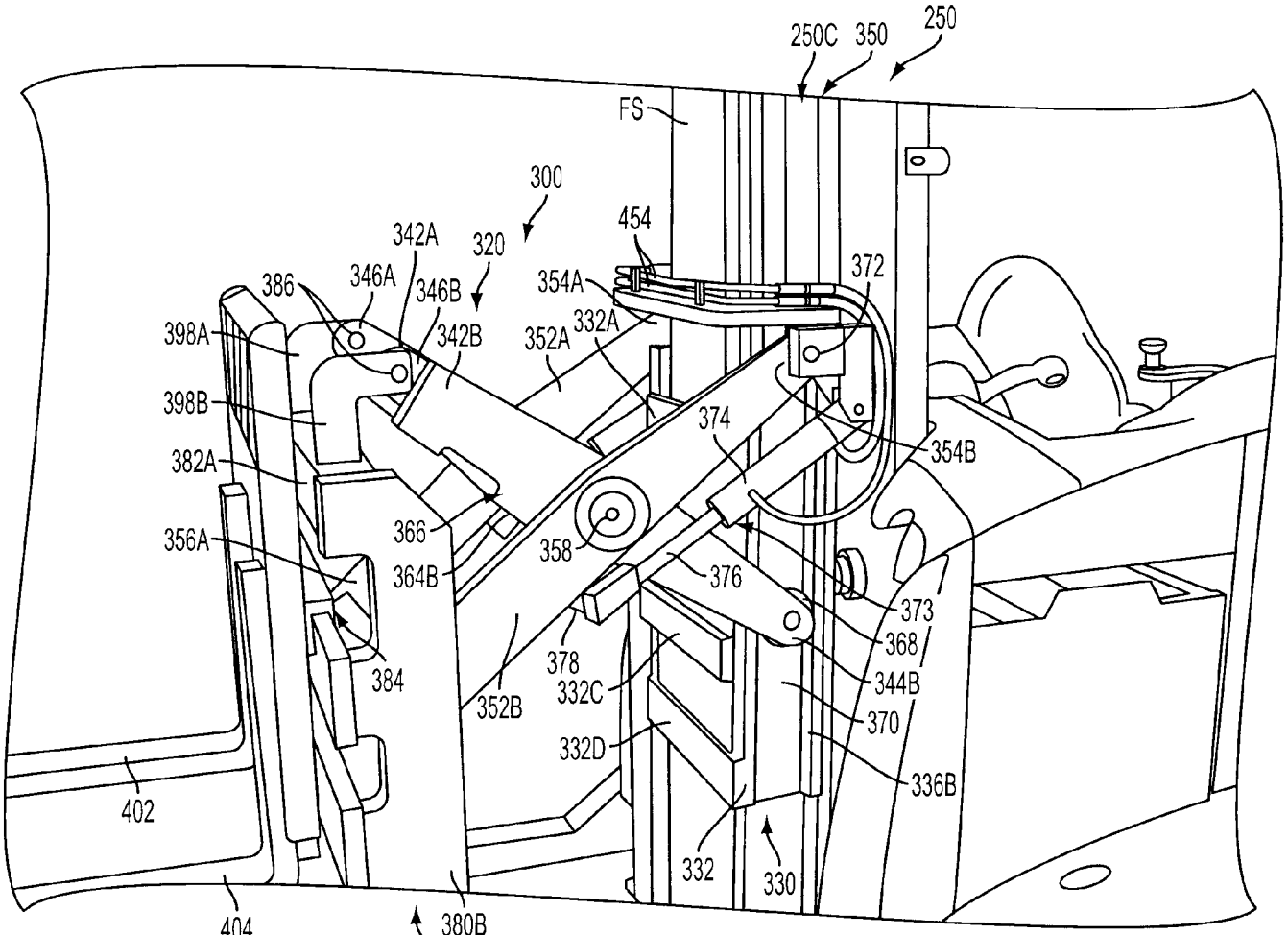
FIG. 5 is a left side view of the materials handling vehicle illustrating a reach mechanism for the fork carriage apparatus.
Figure 6:
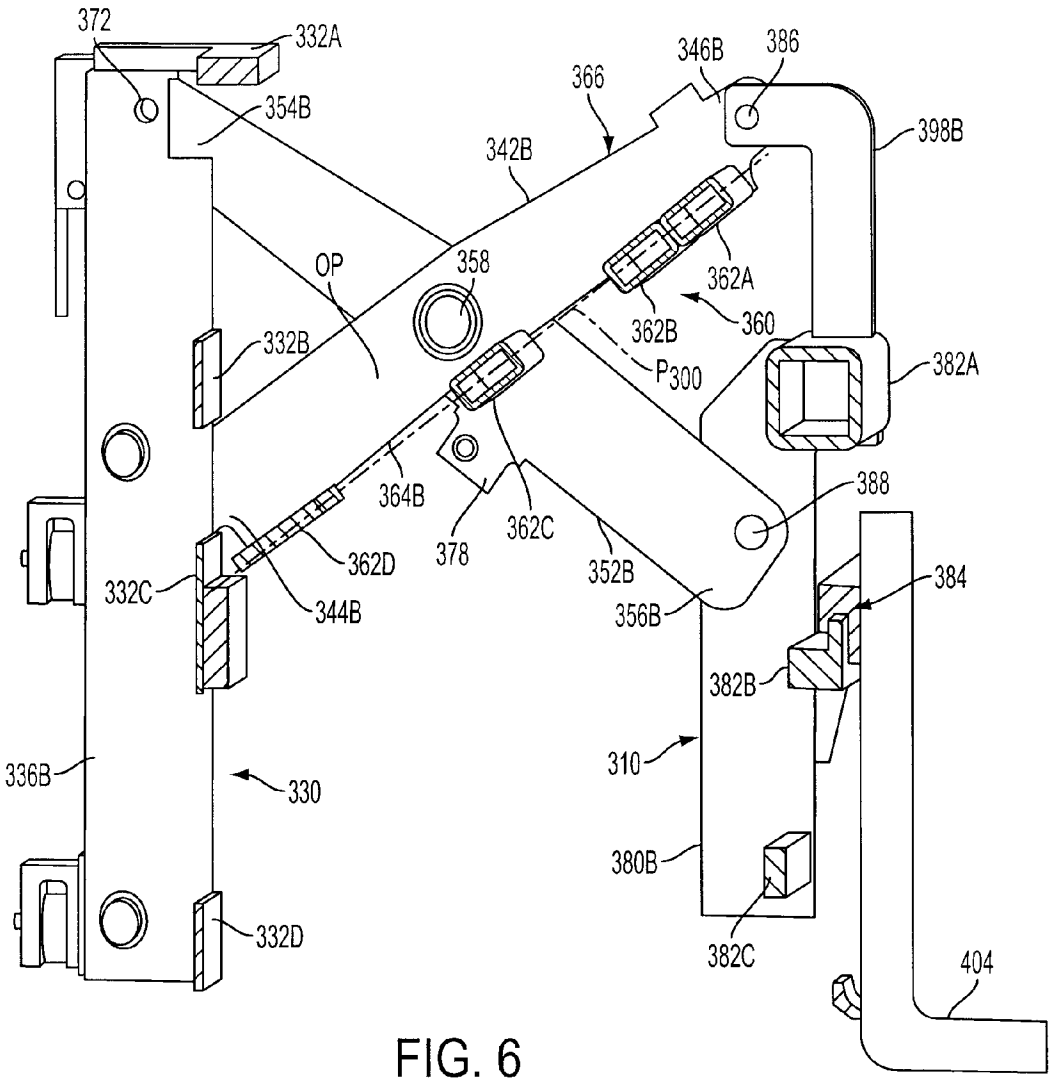
FIG. 6 is a right side cut-away view of the fork carriage apparatus in an extended position.

The first and second inner arms 342A and 342B are coupled to the first and second outer arms 352A and 352B at pivot connections 358, see FIGS. 4, 5 and 6. A hydraulic piston/cylinder apparatus 373 is provided for effecting movement of the reach mechanism 320. In the illustrated embodiment, the piston/cylinder apparatus 373 comprises a cylinder 374 extending from each of the side members 336A and 336B and including a ram 376 extending to a coupling tab 378 provided on each of the first and second outer arms 352A and 352B, see FIGS. 4, 5, 6, 7 and 8. Movement of the rams 376 out of the cylinders 374 effects pivotal movement of the outer arms 352A and 352B outwardly from the side members 336A and 336B to move the fork carriage mechanism 310 in a longitudinal direction, as designated by arrow LD in FIG. 7, to an extended position, see FIGS. 4 and 5. Movement of the rams 376 into the cylinders 374 effects movement of the fork carriage mechanism 310 to a retracted position locating the fork carriage mechanism 310 adjacent to the monomast 200, see FIGS. 7 and 8. It is contemplated that the piston/cylinder apparatus 373 may be coupled to the first and second inner arms 342A, 342B instead of the first and second outer arms 352A, 352B.

Figure 7:
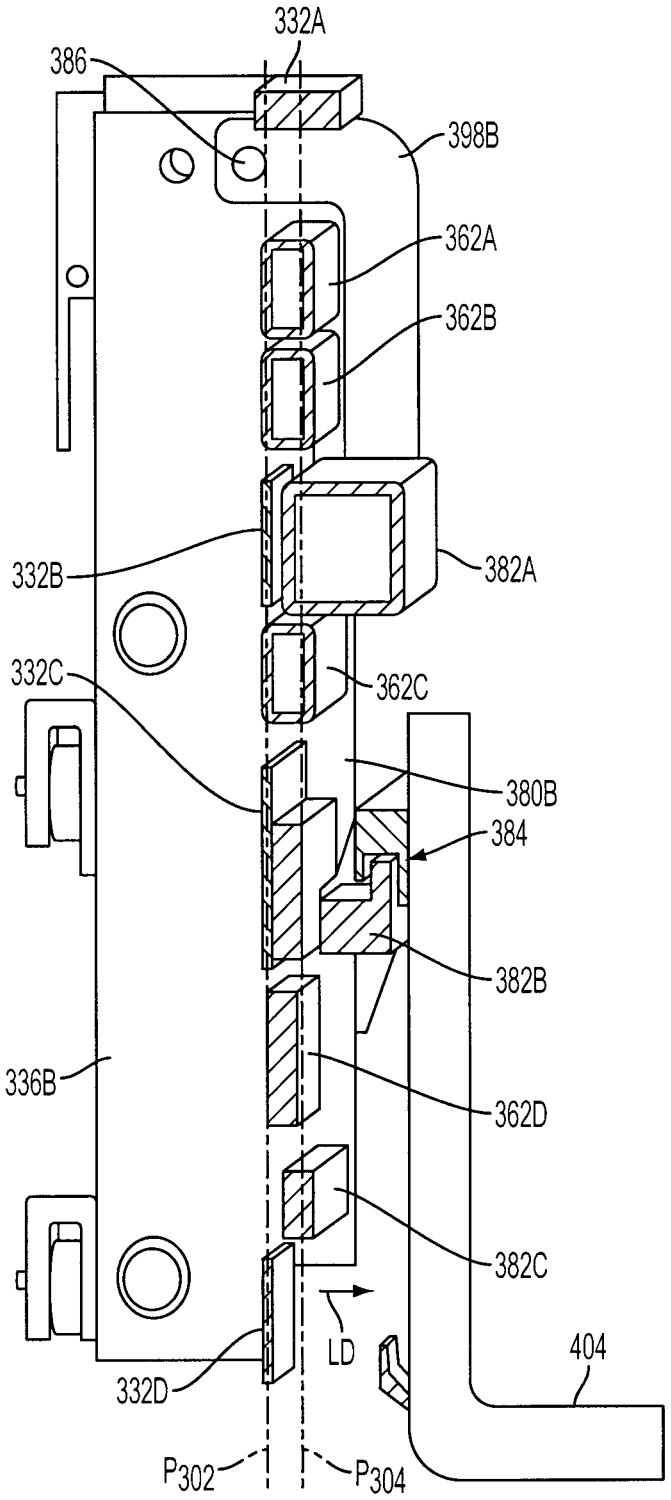
FIG. 7 is a right side cut-away view of the fork carriage apparatus in a retracted position.
Figure 8:
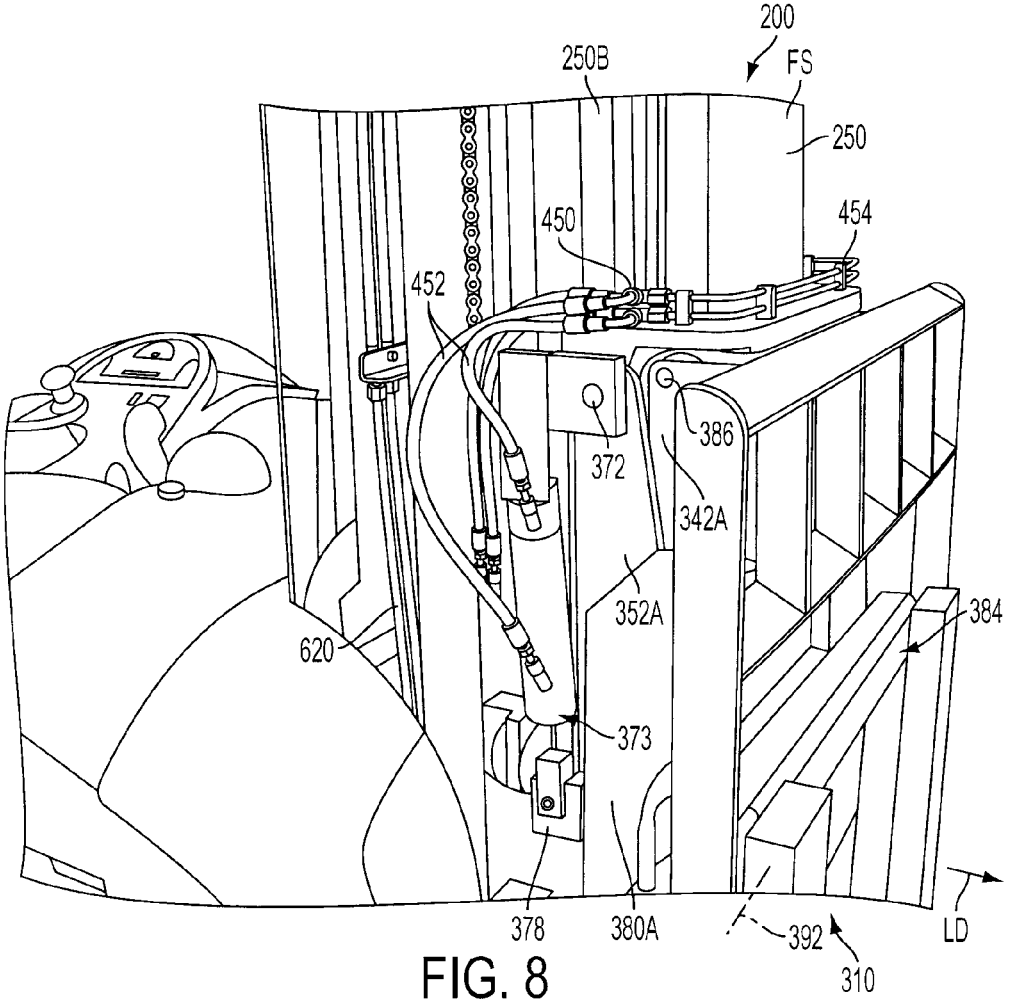
FIG. 8 is a right side perspective view of the fork carriage apparatus in a retracted position.

Referring to FIGS. 3, 5 and 8, the fork carriage mechanism 310 generally comprises in the illustrated embodiment a pair of vertical plates 380A and 380B and first, second and third vertically spaced apart fork frame members 382A, 382B and 382C attached to the vertical plates 380A and 380B, and first and second L-shaped supports 398A and 398B coupled to the first fork frame member 382A, see FIGS. 5, 6 and 7. The second ends 346A and 346B of the first and second inner arms 342A and 342B are attached to the L-shaped supports 398A and 398B at connection locations 386, and the second ends 356A and 356B of the first and second outer arms 352A and 352B are attached to the vertical plates 380A and 380B at connection locations 388, see FIGS. 5, 6 and 8 (only the connection of outer arm 352B to vertical plate 380B is shown in the drawings). The forks 402 and 404 are supported on the second fork frame member 382B via a side shift structure 384 forming part of the carriage frame mechanism 310. In the illustrated embodiment, the side shift structure 384 comprises a conventional side shift apparatus that allows the forks 402 and 404 to be manually moved toward or away from each other or in unison side-to-side along a transverse axis 392, see FIG. 8.

A cross member structure 360 extends between the first and second inner arms 342A and 342B and comprises in the illustrated embodiment first, second, third and fourth laterally extending cross members 362A, 362B, 362C and 362D, see FIG. 6. The lateral edges or ends of the cross members 362A, 362B, 362C and 362D are preferably attached at or adjacent to front edges 364A and 364B of the inner arms 342A and 342B, see FIGS. 4 and 6. The cross members 362A, 362B, 362C and 362D are generally aligned in a common cross member plane $P_{300}$ extending adjacent to the front edges 364A and 364B of the inner arms 342A and 342B, see FIG. 6. The cross member structure 360 together with the inner arms 342A and 342B define an inner arm weldment 366 that functions to substantially resist torsional forces applied to the reach mechanism 320, such as through load forces applied on the fork carriage mechanism 310, see FIGS. 4, 5 and 6. The area within the inner arm weldment 366, i.e., behind the cross member structure 360, comprises an open pocket OP for receiving the fork carriage assembly 330 during retracting movement of the reach mechanism 320, as is described further below, see FIG. 6. Although the cross members 362A, 362B, 362C and 362D may be formed with any cross sectional configuration to provide rigidity to the inner arm weldment 366, in the illustrated embodiment, the first, second and third cross members 362A, 362B and 362C have a rectangular tubular cross section and the fourth cross member 362D has a rectangular solid or plate-like cross section, see FIGS. 6 and 7.

In the retracted position of the fork carriage mechanism 310, the cross members 362A, 362B, 362C and 362D of the inner arm weldment 366 and one or more of the carriage frame members 332A, 332B, 332C, 332D of the mast carriage assembly 320 are preferably located in a first common vertical plane $P_{302}$ extending substantially parallel to the front side FS of the monomast 200, see FIG. 7. The carriage frame members 332A, 332B, 332C, 332D are positioned such that they are located in vertically spaced relation to the cross members 362A, 362B, 362C and 362D, and the cross members 362A, 362B, 362C and 362D may be in at least partially nested relation between the carriage frame members 332A, 332B, 332C, 332D, when the fork carriage mechanism 310 is in the retracted position. Similarly, the fork frame members 382A, 382B and 382C are preferably located in vertically spaced relation to the cross members 362A, 362B, 362C and 362D, and at least one of the fork frame members 382A, 382B and 382C is located in a second common vertical plane $P_{304}$ with one or more of the cross members 362A, 362B, 362C and 362D, substantially parallel to the front side FS of the monomast 200, when the fork carriage mechanism 310 is in the retracted position, see FIG. 7. The space between at least two of the cross members 362B and 362C may accommodate at least one carriage frame member 332B, and at least one fork frame member 382A, as illustrated in FIG. 7 by the fork frame member 382A having a square cross section.

The arrangement of the cross members 362A, 362B, 362C and 362D in vertically spaced relation to the carriage frame members 332A, 332B, 332C, 332D and the fork frame members 382A, 382B and 382C facilitates close positioning of the cross member structure 360 to the fork carriage assembly 330 and, hence, to the front of the monomast 200 and close positioning of the fork carriage mechanism 310 to the inner arm weldment 366, to minimize the overall longitudinal length of the fork carriage apparatus 300 in the longitudinal direction LD, and hence the overall longitudinal length of the truck 100 in the longitudinal direction LD, when the fork carriage mechanism 310 is in the retracted position, see FIGS. 7 and 8.

The compact configuration of the fork carriage apparatus 300 in relation to the monomast 200 is additionally facilitated by the inner and outer arms 342A, 342B and 352A, 352B extending substantially vertically along the outer sides of the side members 336A and 336B of the mast carriage assembly 330, see FIGS. 7 and 8. By locating the cross member structure 360 adjacent the front edges 364A and 364B of the inner arms 342A and 342B, the inner arm weldment 366 may be positioned extending around the fork carriage assembly 330 and the monomast 200 with the vertical plates 380A and 380B of the fork carriage mechanism 310 positioned along the outer sides of the outer arms 352A and 352B of the reach mechanism 320, see FIGS. 3 and 8.

Figure 12:
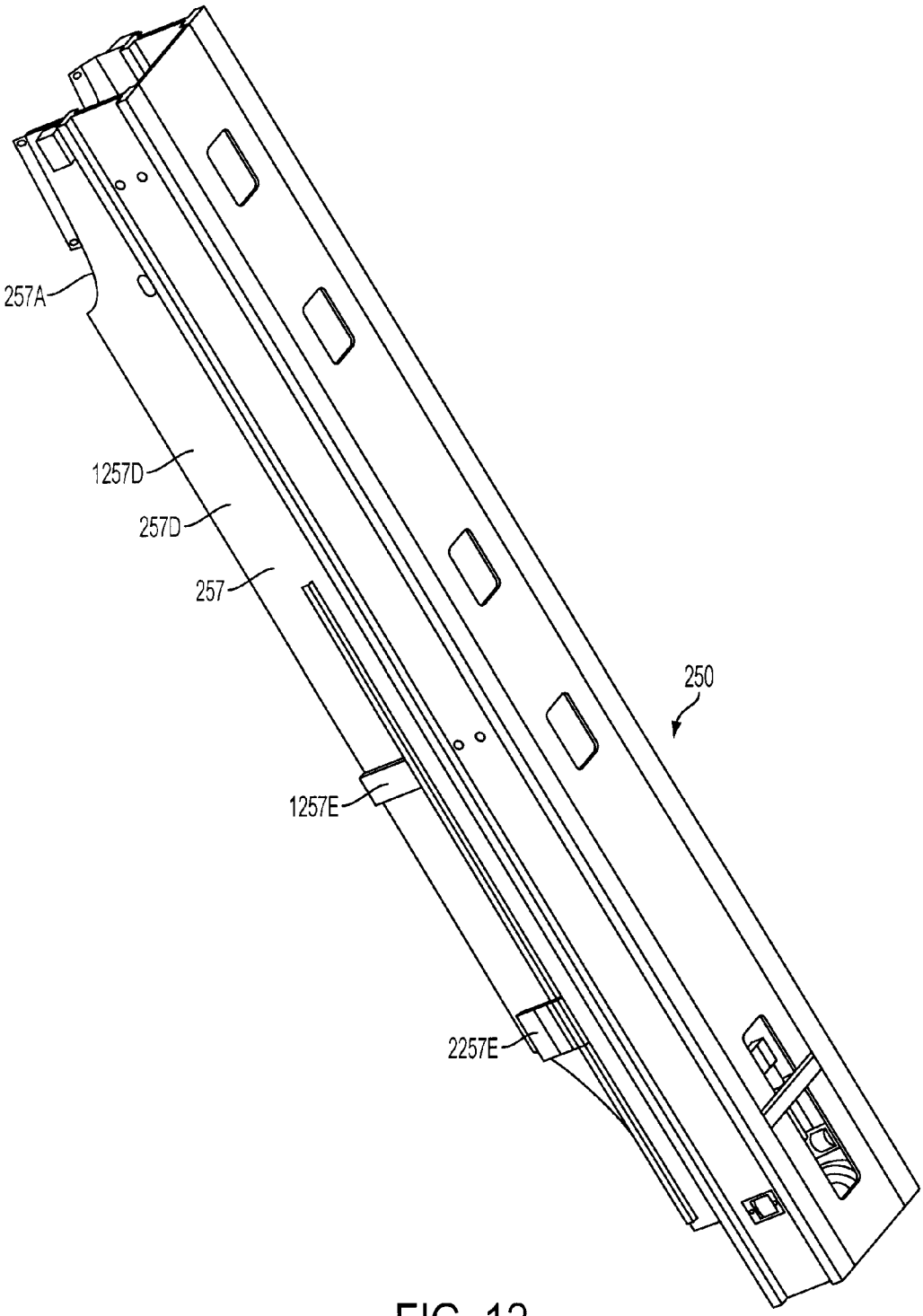
FIG. 12 is a right side front perspective view of the third stage weldment.
Figure 13:
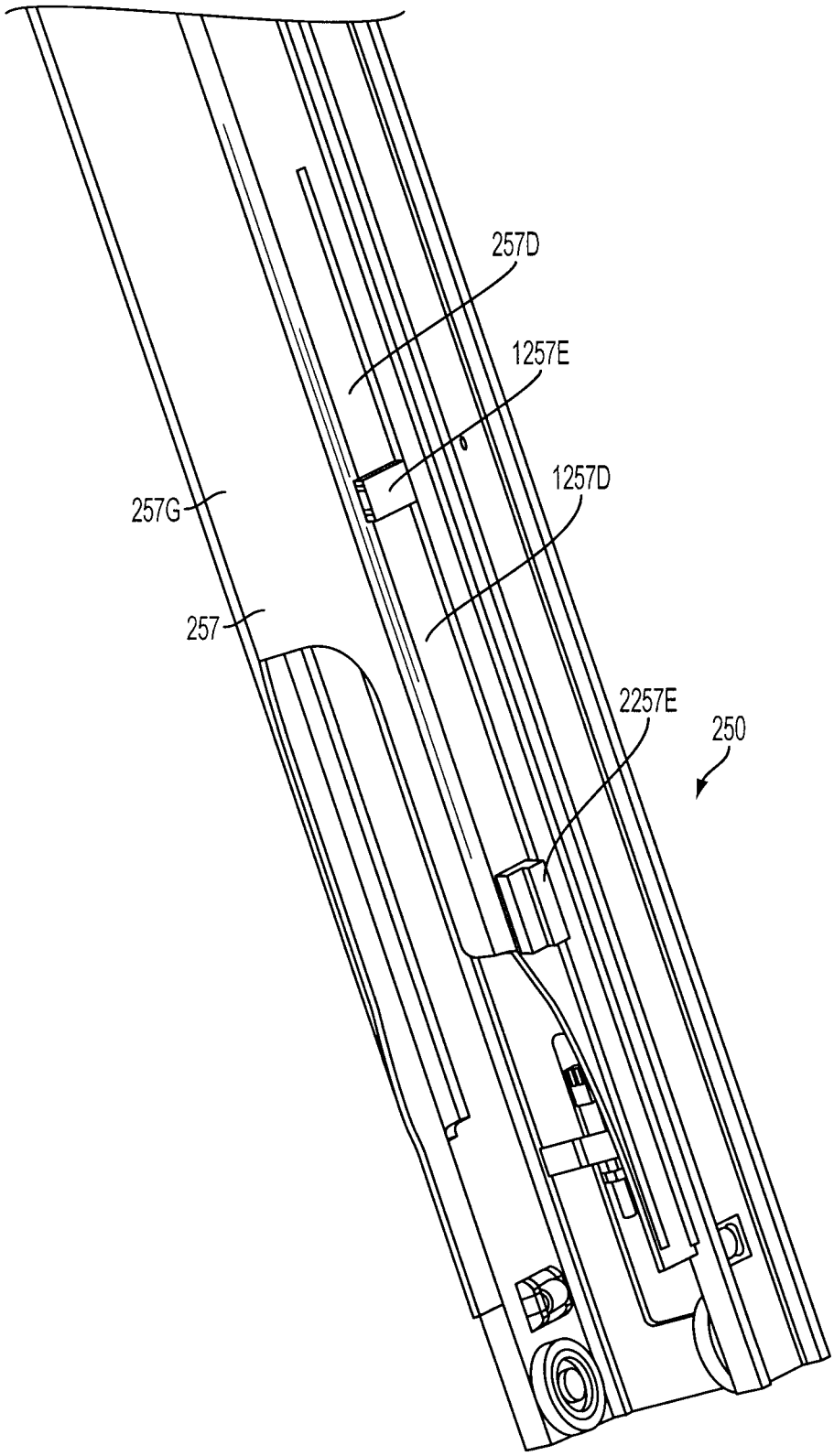
FIG. 13 is a right side rear perspective view of the third stage weldment.

The fork carriage apparatus lift structure 400 comprises a hydraulic piston/cylinder apparatus 410 including a cylinder 412 and a ram 414, see FIG. 4. The cylinder 412 is fixedly coupled to a side section 257D of a third stage weldment rear plate 257 via first and second upper coupling elements 1257E and 1257F and first and second lower coupling elements 2257E and 2257F, see FIGS. 3, 12, 13, 14 and 15. The first upper coupling element 1257E is welded to the side section 257D of the third stage weldment rear plate 257, see FIGS. 3, 12 and 13. The second upper coupling element 1257F is welded to the cylinder 412, see FIGS. 14 and 15. The first upper coupling element 1257E and the second upper coupling element 1257F are bolted together via bolts 3257A, see FIGS. 14 and 15. The first lower coupling element 2257E is welded to the side section 257D of the third stage weldment rear plate 257, see FIGS. 12, 13 and 15. The second lower coupling element 2257F is welded to the cylinder 412, see FIG. 15. The first lower coupling element 2257E and the second lower coupling element 2257F are joined via pin 3257B, see FIG. 15. The cylinder 412 is mounted to a rear portion 1257D of the side section 257D near an intersection 257F of the side section 257D and a back section 257G of the rear plate 257, see FIGS. 3 and 13.

First and second pulleys 420 and 422 are coupled to an upper end of the ram 414, see FIG. 4. A lift chain 440 extends over the first pulley 420 and is coupled at a first end 440A to the cylinder 412 via chain anchors and a bracket 441 welded to the cylinder 412 and at its second end 440B to the mast carriage assembly 330, see FIG. 4. Vertical movement of the ram 414 effects vertical movement of the entire fork carriage apparatus 300 relative to the third stage weldment 250. Supply and return hydraulic hoses 430 extend over the second pulley 422 or a separate pulley, see FIG. 4. The hydraulic hoses 430 define hydraulic fluid supply and return paths for the fork carriage apparatus 300. One or more electrical cables 431 may also extend over the second pulley 422, see FIGS. 4 and 14. The one or more electrical cables 431 may control the operation of one or more electronically controlled valves forming part of the fork carriage apparatus 300.

Figure 14:
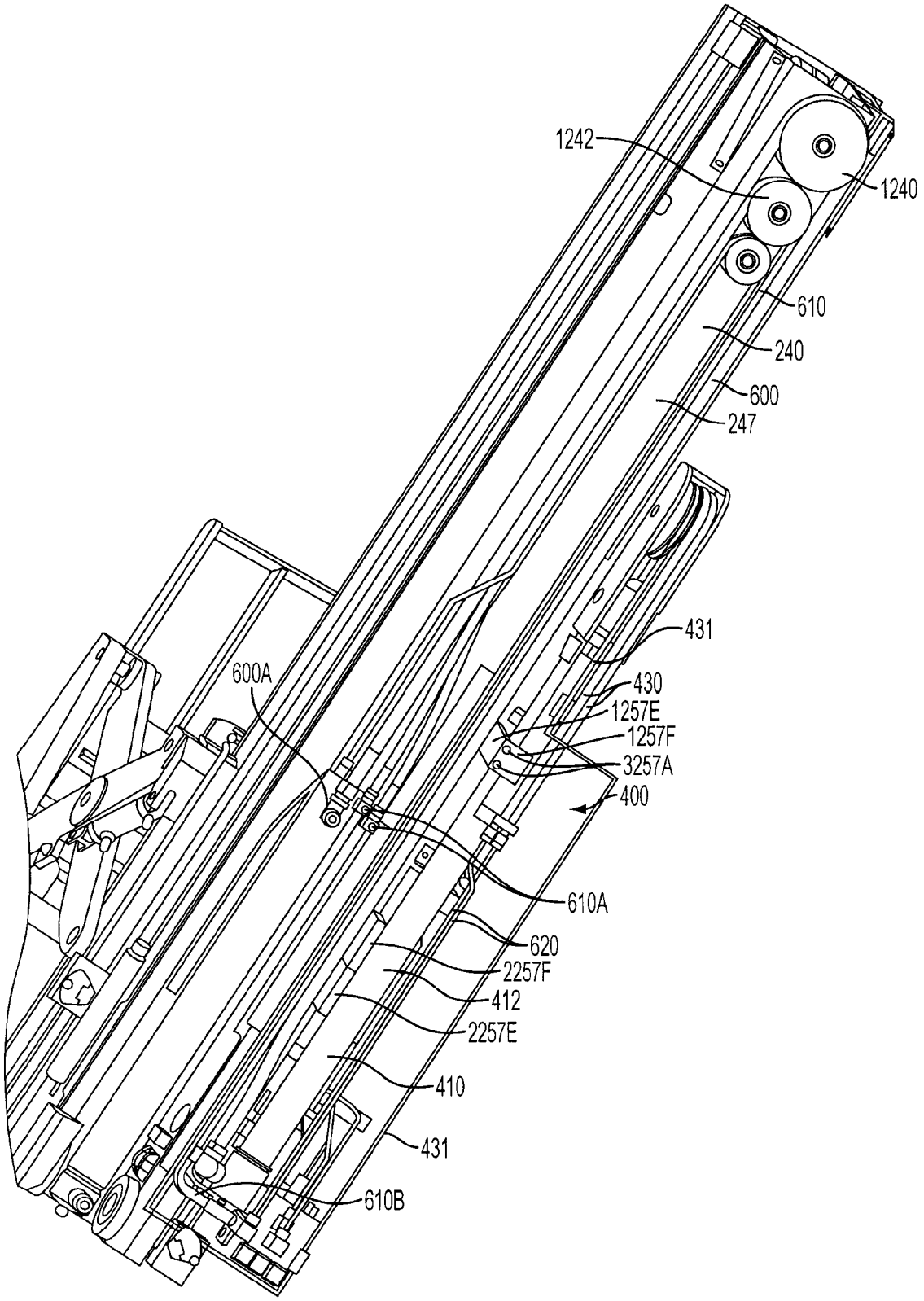
FIG. 14 is a perspective view of a rear portion of the monomast and fork carriage apparatus with a power unit of the vehicle and a third stage weldment removed.
Figure 15:
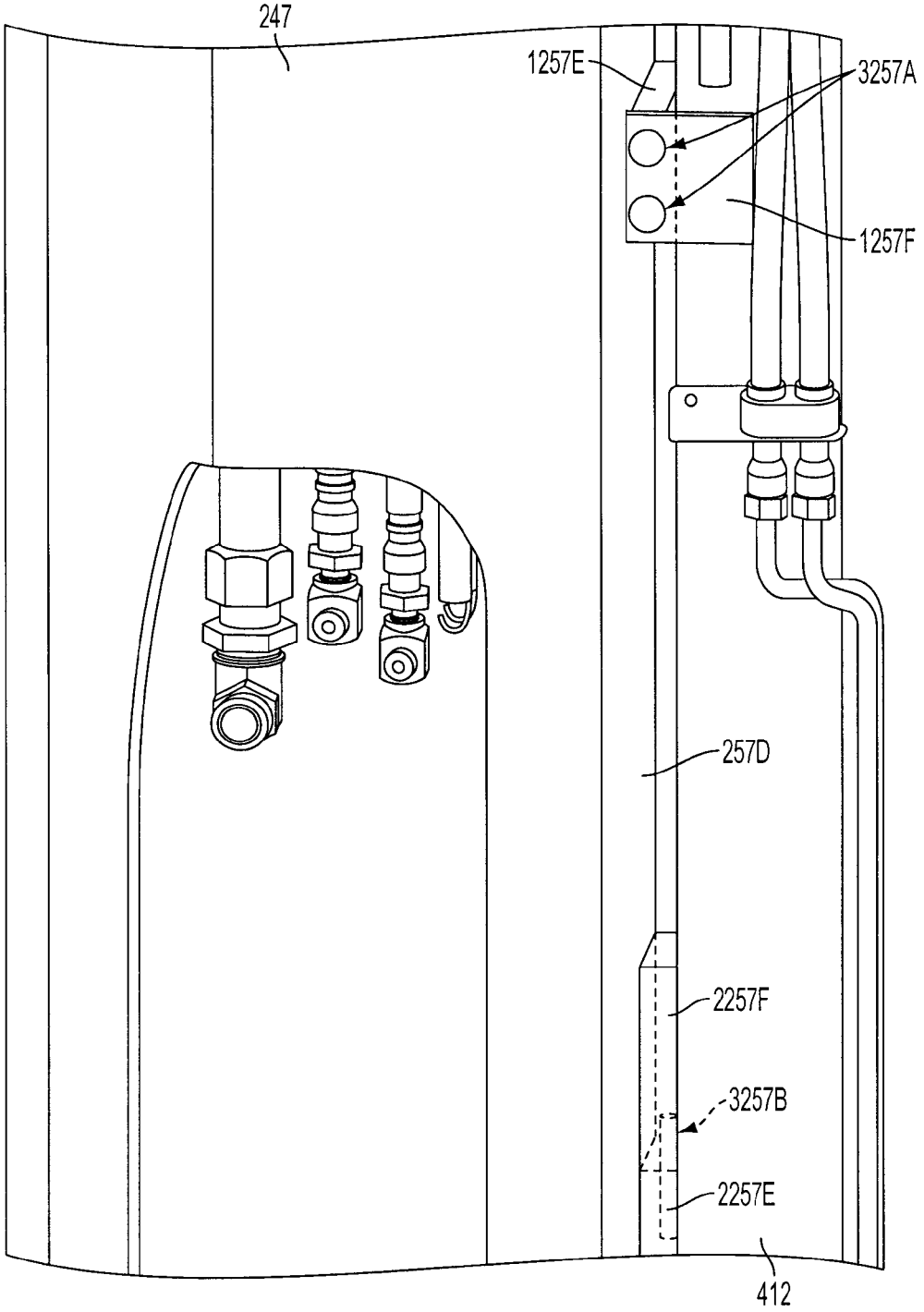
FIG. 15 is a rear view of the third stage weldment illustrating the cylinder of the fork carriage lift structure coupled to the third stage weldment rear plate.

A hydraulic hose 600 extends over a first pulley 1240 coupled to a rear plate 247 of the second stage weldment 240, see FIG. 14 (the third stage weldment 250 is not illustrated in FIG. 14). The hose 600 is coupled at a first end 600A to a hydraulic supply source (not shown) on the vehicle power unit 102 and to a base of the cylinder 412 of the fork carriage apparatus lift structure 400, see FIG. 14.

First and second hydraulic supply and return hoses 610 extend over a second pulley 1242 coupled to the rear plate 247 of the second stage weldment 240, see FIG. 14. First ends 610A of the hydraulic hoses 610 are coupled to appropriate hydraulic fluid supply and return structure provided on the vehicle power unit 102 and second ends 610B of the hydraulic hoses 610 are coupled to metal lines 620, which, in turn, are coupled to the hydraulic hoses 430 discussed above.

Referring to FIGS. 4 and 5, hydraulic fluid may be conveyed from the hydraulic hoses 430 to a manifold 456. The manifold 456 includes solenoid actuated valves (not shown) controlling supply of fluid through hydraulic hoses 432 to a fluid junction 450. The fluid junction 450 is coupled to hydraulic fluid supply and return structure 452 extending to the piston/cylinder apparatus 373 coupled to the first arm 352A to effect movement of the ram 376 relative to the cylinder 374. Metal lines 454 may extend from the fluid junction 450 around the front side of the third stage weldment 250 to provide hydraulic fluid to the piston/cylinder apparatus 373 on the opposite side of the monomast 200, see FIG. 5.

Figure 9:
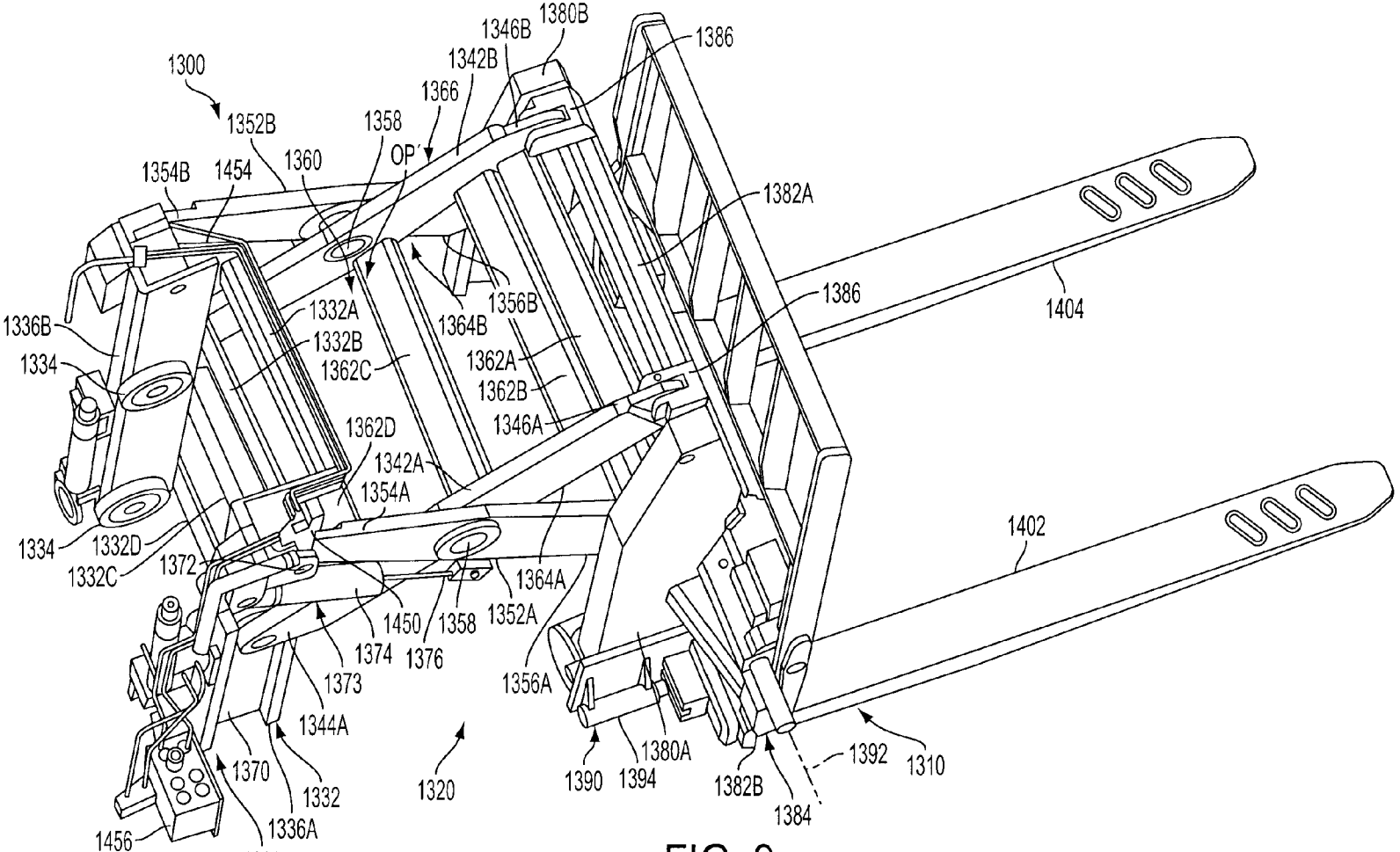
FIG. 9 is a top perspective view of an alternative embodiment of the fork carriage apparatus in an extended position.
Figure 10:
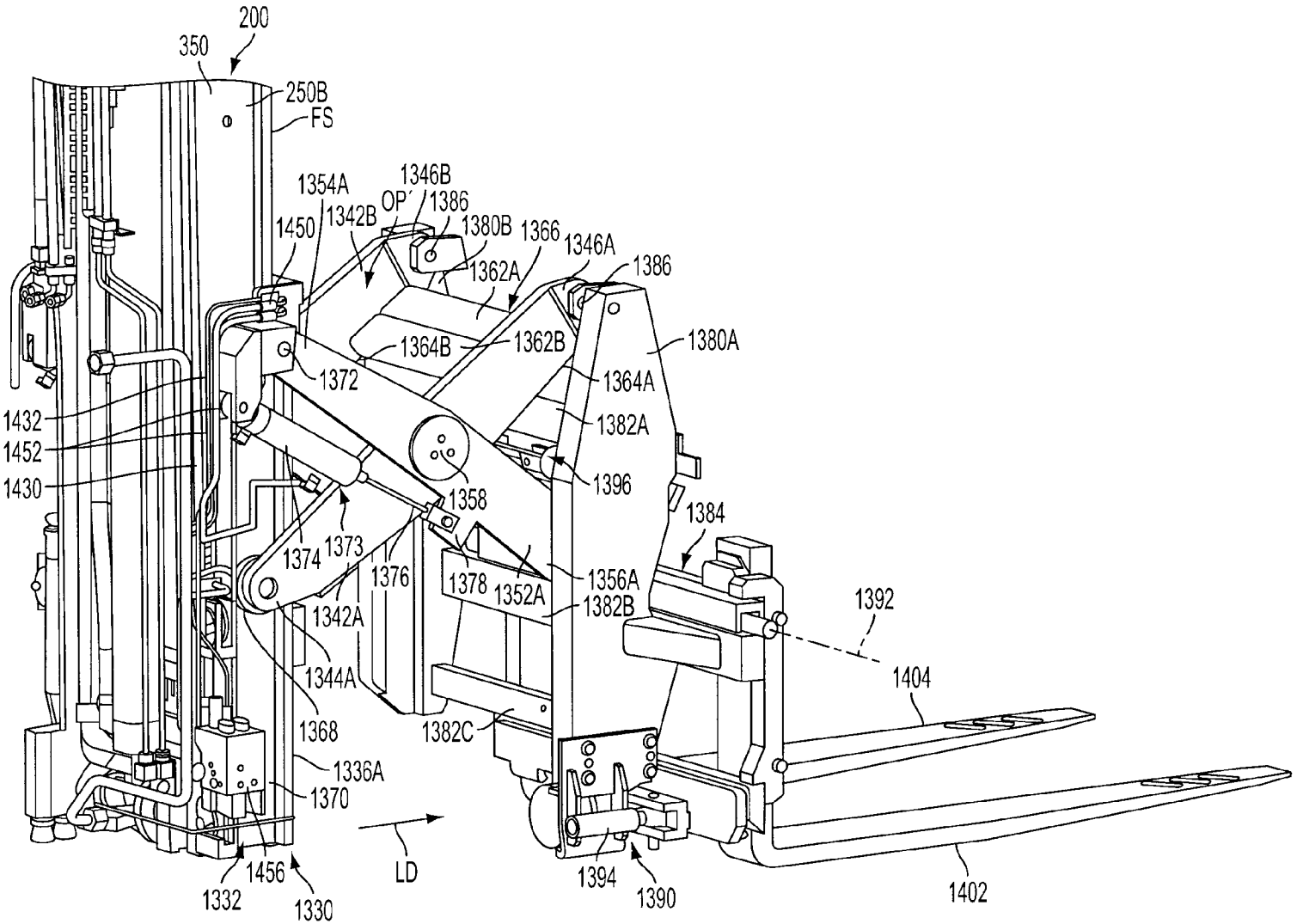
FIG. 10 is a right rear perspective view of the alternative embodiment of FIG. 9 showing the fork carriage apparatus in an extended position.
Figure 11:
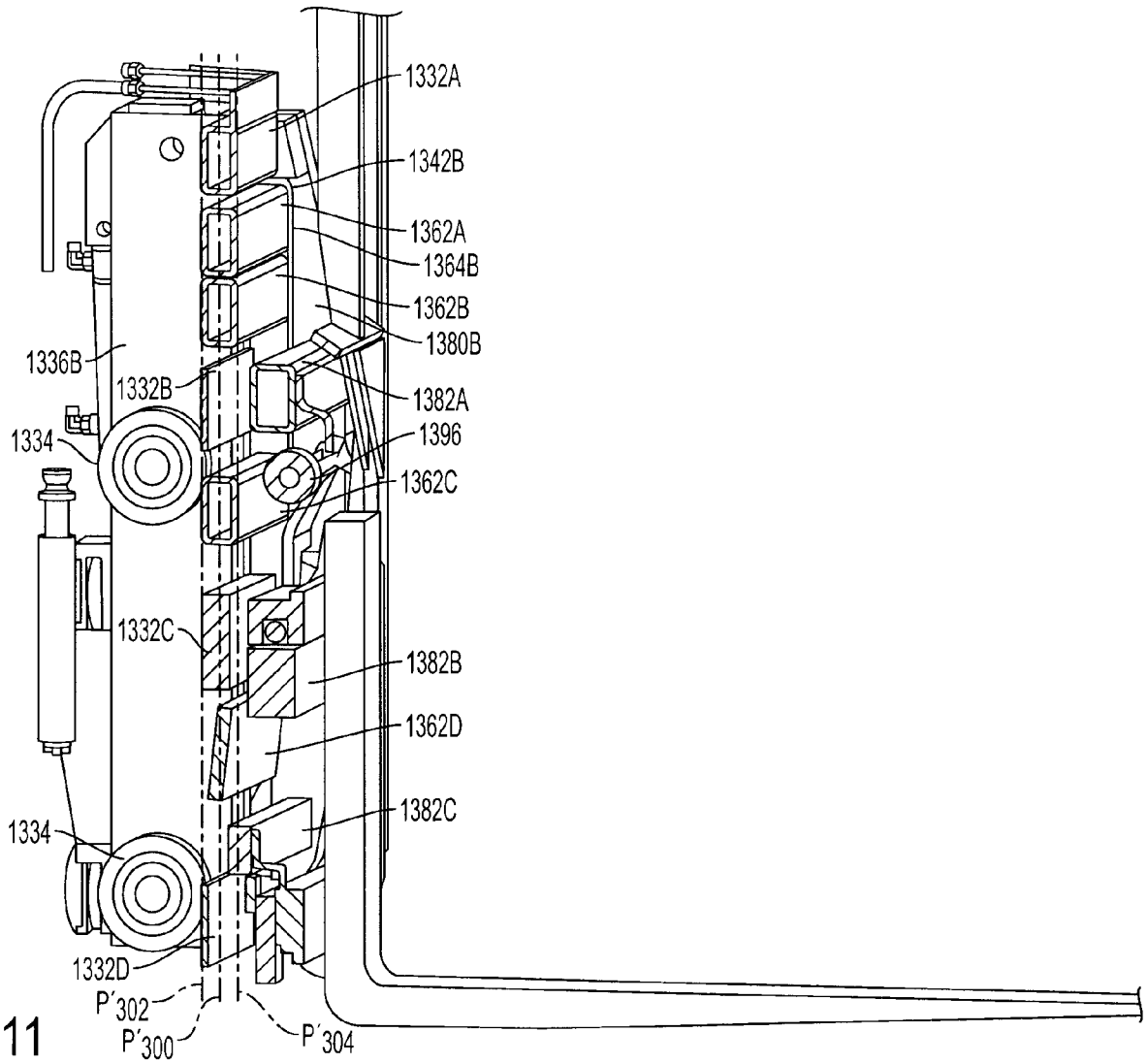
FIG. 11 is a right side cut-away view of the alternative embodiment of FIG. 9 showing the fork carriage apparatus in a refracted position.

It should be noted that variations on the above-described structure may be provided for forming a compact longitudinal length when the fork carriage mechanism 310 is located in the retracted position. For example, FIGS. 9, 10 and 11 illustrate an alternative embodiment of the fork carriage apparatus in which elements corresponding to the first described embodiment are labeled with the same reference numeral increased by 1000. In accordance with the second illustrated embodiment, a fork carriage apparatus 1300 comprises a fork carriage mechanism 1310 to which first and second forks 1402, 1404 are mounted. The fork carriage mechanism 1310 is mounted to a reach mechanism 1320 which, in turn, is mounted to a mast carriage assembly 1330. The mast carriage assembly 1330 comprises a main unit 1332 including first and second side members 1336A and 1336B, see FIGS. 9 and 10. Each of the side members 1336A, 1336B support a plurality of rollers 1334 which are received in the tracks 350 formed in the opposing outer side surfaces 250B and 250C of the third stage weldment 250, see FIG. 3. In the illustrated embodiment, the main unit 1332 further comprises first, second, third and fourth vertically spaced apart and horizontally extending carriage frame members 1332A, 1332B, 1332C and 1332D extending across the front side FS of the monomast 200, see FIGS. 10 and 11. The carriage frame members 1332A, 1332B, 1332C, 1332D are rigidly attached to the side members 1336A and 1336B.

The reach mechanism 1320 comprises a pantograph or scissors structure having first and second inner arms 1342A and 1342B, and first and second outer arms 1352A and 1352B, see FIGS. 9 and 10. The first and second inner arms 1342A and 1342B include first ends 1344A and 1344B (only the first end 1344A is shown in FIGS. 9-11) directly coupled to the side members 1336A and 1336B of the mast carriage assembly 1330, and second ends 1346A and 1346B pivotally coupled to the fork carriage mechanism 1310. Each of the first ends 1344A and 1344B (1344B not shown) includes a roller 1368. The rollers 1368 are received in vertically extending tracks 1370 formed in the outer sides of the side members 1336A and 1336B. The rollers 1368 engaged within the tracks 1370 form a sliding coupling between the first ends 1344A and 1344B (1344B not shown) of the inner arms 1342A and 1342B and the side members 1336A and 1336B.

The first and second outer arms 1352A and 1352B include first ends 1354A and 1354B directly coupled to the side members 1336A and 1336B of the mast carriage assembly 1330, and second ends 1356A and 1356B pivotally coupled to the fork carriage mechanism 1310, see FIG. 9. Each of the side members 1336A and 1336B includes a pivot location 1372 where the first ends 1354A and 1354B of the first and second outer arms 1352A and 1352B are coupled to the side members 1336A and 1336B (only pivot connection 1372 to side member 1336A is shown), see FIGS. 9 and 10.

The first and second inner arms 1342A and 1342B are coupled to the first and second outer arms 1352A and 1352B at pivot connections 1358, see FIGS. 9 and 10. A hydraulic piston/cylinder apparatus 1373 is provided for effecting movement of the reach mechanism 1320. In the illustrated embodiment, the piston/cylinder apparatus 1373 comprises a cylinder 1374 extending from each of the side members 1336A and 1336B and including a ram 1376 extending to a coupling tab 1378 provided on each of the first and second outer arms 1352A and 1352B (only piston/cylinder apparatus 1373 connected to outer arm 1352A shown), see FIGS. 9 and 10. Movement of the rams 1376 out of the cylinders 1374 effects pivotal movement of the outer arms 1352A and 1352B outwardly from the side members 1336A and 1336B to move the fork carriage mechanism 1310 in a longitudinal direction, as designated by arrow LD in FIG. 10, to an extended position, see FIGS. 9 and 10. Movement of the rams 1376 into the cylinders 1374 effects movement of the fork carriage mechanism 1310 to a retracted position locating the fork carriage mechanism 1310 adjacent to the monomast 200, see FIG. 11. It is contemplated that the piston/cylinder apparatus 1373 may be coupled to the first and second inner arms 1342A, 1342B instead of the first and second outer arms 1352A, 1352B.

In the illustrated embodiment, the fork carriage mechanism 1310 generally comprises a pair of vertical plates 1380A and 1380B and first, second and third vertically spaced apart fork frame members 1382A, 1382B and 1382C attached to the vertical plates 1380A and 1380B, see FIGS.

10 and 11. The second ends 1346A and 1346B of the first and second inner arms 1342A and 1342B are attached to the vertical plates 1380A and 1380B at connection locations 1386, and the second ends 1356A and 1356B of the first and second outer arms 1352A and 1352B are attached to the vertical plates 1380A and 1380B at connection locations (not shown), see FIGS. 9 and 10. The forks 1402 and 1404 are supported on the second fork frame member 1382B via a side shift structure 1384 forming part of the carriage frame mechanism 1310. In the illustrated embodiment, the side shift structure 1384 comprises a conventional hydraulically actuated side shift mechanism including a hydraulic piston/cylinder 1396 that effects movement of the forks 1402 and 1404 toward or away from each other or in unison side-to-side along a transverse axis 1392, see FIGS. 10 and 11. Additional positioning of the forks 1402 and 1404 may be provided by a tilt structure 1390 which in the illustrated embodiment comprises a single hydraulic piston/cylinder 1394 supported on the vertical plate 1380A for effecting tilting movement of the forks 1402 and 1404 about the transverse axis 1392, see FIGS. 9 and 10.

A cross member structure 1360 extends between the first and second inner arms 1342A and 1342B and comprises in the illustrated embodiment first, second, third and fourth laterally extending cross members 1362A, 1362B, 1362C and 1362D, see FIGS. 9 and 11. The lateral edges or ends of the cross members 1362A, 1362B, 1362C and 1362D are preferably attached at or adjacent to front edges 1364A and 1364B of the inner arms 1342A and 1342B, see FIGS. 9 and 10. The cross members 1362A, 1362B, 1362C and 1362D are generally aligned in a common cross member plane $P'_{300}$, see FIG. 11, extending adjacent to the front edges 1364A and 1364B of the inner arms 1342A and 1342B (only front edge 1364B and inner arm 1342B are shown in FIG. 11). The cross member structure 1360 together with the inner arms 1342A and 1342B define an inner arm weldment 1366, and the area within the inner arm weldment 1366, i.e., behind the cross member structure 1360, comprises an open pocket OP' for receiving the mast carriage assembly 1330 and the monomast 200 during retracting movement of the reach mechanism 1320, see FIGS. 9 and 10. In the illustrated embodiment, the first, second and third cross members 1362A, 1362B and 1362C have a rectangular tubular cross section and the fourth cross member 1362D has a rectangular solid or plate-like cross section, see FIG. 11.

In the retracted position of the fork carriage mechanism 1310, the cross members 1362A, 1362B, 1362C and 1362D of the inner arm weldment 1366 and one or more of the carriage frame members 1332A, 1332B, 1332C, 1332D of the mast carriage assembly 1320 are preferably located in a first common vertical plane $P'_{302}$ extending substantially parallel to the front side FS of the monomast 200, see FIG. 11. The carriage frame members 1332A, 1332B, 1332C, 1332D are positioned such that they are located in vertically spaced relation to the cross members 1362A, 1362B, 1362C and 1362D, and the cross members 1362A, 1362B, 1362C and 1362D may be in at least partially nested relation between the carriage frame members 1332A, 1332B, 1332C, 1332D, when the fork carriage mechanism 1310 is in the retracted position. Similarly, the fork frame members 1382A, 1382B and 1382C are preferably located in vertically spaced relation to the cross members 1362A, 1362B, 1362C and 1362D. In the illustrated embodiment, at least one of the fork frame members 1382A is formed with a rectangular cross section elongated in the vertical direction, providing sufficient structural strength to the fork carriage mechanism 1310 without overlapping a second common vertical plane $P'_{304}$ passing through one or more of the cross members 1362A, 1362B, 1362C and 1362D, substantially parallel to the front side FS of the monomast 200, when the fork carriage mechanism 1310 is in the retracted position, see FIG. 11.

The arrangement of the cross members 1362A, 1362B, 1362C and 1362D in vertically spaced relation to the carriage frame members 1332A, 1332B, 1332C, 1332D and the fork frame members 1382A, 1382B and 1382C facilitates close positioning of the cross member structure 1360 to the front of the monomast 200 and close positioning of the fork carriage mechanism 1310 to the inner arm weldment 1366, to minimize the overall longitudinal length of the fork carriage apparatus 1300 in the longitudinal direction LD, and hence the overall longitudinal length of the truck 100 in the longitudinal direction LD, when the fork carriage mechanism 1310 is in the retracted position, see FIG. 11.

A manifold 1456 is supported on the side member 1336A for receiving hydraulic fluid conveyed from hydraulic hoses 1430. Hydraulic fluid may be supplied to the hydraulic hoses 1430 by structure similar to that illustrated in the first embodiment described herein. The manifold 1456 includes solenoid actuated valves (not shown) for controlling supply of fluid through hydraulic hoses 1432 to a fluid junction 1450. The fluid junction 1450 is coupled to hydraulic fluid supply and return hoses 1452 extending to the piston/cylinder apparatus 1373 to effect movement of the ram 1376 relative to the cylinder 1374, see FIG. 10. Metal lines 1454 may extend from the fluid junction 1450 around the front side of the third stage weldment 250 to provide hydraulic fluid to the piston/cylinder apparatus 1373 on the opposite side of the monomast 200, see FIG. 9. In addition, the manifold 1456 controls the supply of hydraulic fluid via hydraulic hoses (not shown) to the piston/cylinder 1396 for effecting movement of the side shift structure 1380, and supplies hydraulic fluid via hydraulic hoses (not shown) to the piston/cylinder 1394 for effecting movement of the tilt structure 1390.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A materials handling vehicle comprising:

a vehicle power unit;

a monomast coupled to said vehicle power unit; and a fork carriage apparatus supported on said monomast;

said fork carriage apparatus comprising:

a mast carriage assembly including first and second side members movably coupled to said monomast, said mast carriage assembly including upper and lower elements connected to and extending between said side members at vertically opposing upper and lower ends of said side members, and at least one carriage frame member having opposing ends attached at an engagement location on each of said side members and extending laterally across a front side of said monomast and located in vertically spaced relation between said upper and lower ends;

a fork carriage mechanism to which forks are mounted; and a reach mechanism coupled to and supported on said side members of said mast carriage assembly, and said reach mechanism coupled to said fork carriage mechanism for effecting movement of said fork carriage mechanism between an extended position and a retracted position, said reach mechanism including at least one laterally extending cross member which is located in vertically spaced relation and intersecting a common vertical plane with said carriage frame member, said vertical plane extending in front of and generally parallel to said monomast when said fork carriage mechanism is in said retracted position, wherein said carriage frame member extends laterally across said front side of said monomast at a fixed vertical location on said mast carriage assembly throughout movement of said fork carriage mechanism between said extended and retracted positions.

2. The materials handling vehicle as set out in claim 1, wherein said at least one carriage frame member comprises first and second carriage frame members extending laterally across said front side of said monomast in vertically spaced relation to said upper and lower ends of said mast carriage assembly, and said cross member is located between said first and second carriage frame members when said fork carriage mechanism is in said retracted position.

3. The materials handling vehicle as set out in claim 1, wherein said reach mechanism comprises a plurality of cross members and said carriage frame member is located between two of said cross members when said fork carriage mechanism is in said retracted position.

4. The materials handling vehicle as set out in claim 3, wherein said fork carriage mechanism includes at least one laterally extending fork frame member, and said fork frame member is located between said two cross members when said fork carriage mechanism is in said retracted position.

5. The materials handling vehicle as set out in claim 1, wherein said opposing ends of said at least one carriage frame member are non-detachably affixed to said engagement locations on said side members.

6. A materials handling vehicle comprising:

a vehicle power unit;

a monomast comprising a first stage weldment coupled to said vehicle power unit, a second stage weldment positioned to telescope over said first stage weldment, and a third stage weldment positioned to telescope over said first and second stage weldments, said third stage weldment including opposing side surfaces, each side surface defining a vertically extending track; and a fork carriage apparatus supported on said monomast;

said fork carriage apparatus comprising:

a mast carriage assembly directly coupled to said third stage weldment for vertical movement relative to said monomast and including first and second side members supported on opposing sides of said third stage weldment, said mast carriage assembly including rollers supported to laterally inwardly facing sides of each of said first and second side members, said rollers being engaged in said tracks of said third stage weldment, both of said side surfaces of said third stage weldment located between said first and second side members;

a fork carriage mechanism to which forks are mounted; and a reach mechanism including a scissors structure coupled to said mast carriage assembly and to said fork carriage mechanism for effecting movement of said fork carriage mechanism between an extended position and a retracted position, wherein said scissors structure of said reach mechanism comprises:

first and second inner arms coupled to first and second outer arms; and wherein said inner and outer arms extend substantially vertically and are in overlapping relationship over said laterally outwardly facing sides of said first and second side members when said fork carriage mechanism is in said retracted position;

wherein said monomast defines a longitudinal axis extending centrally between and parallel to said side members, and said first and second stage weldments each include a pair of members extending parallel to and on either side of said longitudinal axis, wherein said pairs of members of said first and second stage weldments are located closer to said longitudinal axis than said side members of said mast carriage assembly.

7. The materials handling vehicle as set out in claim 6, wherein said scissors structure of said reach mechanism comprises:

each of said first and second inner arms includes a first end directly supported for movement along a vertical track in a respective one of said side members and a second end coupled to said fork carriage mechanism; and each of said first and second outer arms includes a first end directly coupled at a pivot point to a respective one of said side members and a second end coupled to said fork carriage mechanism.

8. The materials handling vehicle as set out in claim 7, wherein said reach mechanism further includes a plurality of cross members extending between said first and second inner arms, and having lateral edges attached adjacent to front edges of said first and second inner arms to define an inner arm weldment.

9. The materials handling vehicle as set out in claim 6, wherein said rollers are located laterally inwardly from said laterally inwardly facing sides of said first and second side members.

* * * * *